US006351851B1

(12) United States Patent
Yardan

(10) Patent No.: US 6,351,851 B1
(45) Date of Patent: Mar. 5, 2002

(54) PERSONAL SHELTER DEVICE

(76) Inventor: Stephen J. Yardan, 210 Stony Creek Rd., Branford, CT (US) 06405

( * ) Notice: Subject to any disclaimer, the term of this patent is extended or adjusted under 35 U.S.C. 154(b) by 0 days.

(21) Appl. No.: 09/774,905

(22) Filed: Jan. 31, 2001

(51) Int. Cl.[7] ..... A41D 3/08
(52) U.S. Cl. ..... 2/89; 2/69; 135/95
(58) Field of Search ..... 2/456, 89, 69, 2/69.5, 84, 88; 135/90, 87, 95, 96, 900, 908; 224/154

(56) References Cited

U.S. PATENT DOCUMENTS

| | | | | | |
|---|---|---|---|---|---|
| 703,245 | A | * | 6/1902 | Faulkner | 2/89 |
| 1,193,443 | A | | 8/1916 | Swan | |
| 1,895,911 | A | | 1/1933 | Bosson, Jr. | |
| 2,093,889 | A | | 9/1937 | Horn | |
| 3,837,006 | A | | 9/1974 | Laseman | |
| 3,958,274 | A | | 5/1976 | Klauber | |
| 4,594,735 | A | | 6/1986 | Rolf et al. | |
| 4,598,725 | A | | 7/1986 | Brewer | |
| 4,605,029 | A | * | 8/1986 | Russell | 135/95 |
| 4,703,521 | A | | 11/1987 | Asher et al. | |
| 5,924,132 | A | | 7/1999 | Wigutow | |

* cited by examiner

*Primary Examiner*—John J. Calvert
*Assistant Examiner*—Tejash Patel
(74) *Attorney, Agent, or Firm*—Bachman & LaPoint, P.C.

(57) ABSTRACT

A personal shelter device including a foldable outer structure convertible between a poncho configuration and a tent configuration, wherein when the structure is in the poncho configuration, the structure has a poncho front and a poncho rear so as to form a wearable garment and wherein when the structure is in the tent configuration the structure has a tent top, a tent base and a tent front, so as to form a shelter device which defines an enlargeable internal cavity for sheltering a plurality of human beings and at least one supporting member for independently supporting the device when the structure is in the tent configuration, the supporting member being configurable between a compact position for storage when the structure is in the poncho configuration and an extended position for supporting the structure when the structure is in the tent configuration so as to form a self supporting structure.

24 Claims, 5 Drawing Sheets

PERSONAL SHELTER DEVICE

BACKGROUND OF THE INVENTION

The present invention relates to a personal shelter device that is configurable between a poncho configuration and a tent configuration capable of providing shelter to a plurality of human beings for either camping or sleeping.

Many attempts have been made at combining a 'poncho' type garment with a tent like enclosure, but these designs are impractical, bulky and deficient in a number of areas. One approach at this design requires that multiple separate garments be combined so as to create a tent like enclosure large enough for sleeping. In order for one person to use this device effectively, that person would have to carry multiple devices and use these multiple devices in tandem with each other. This increases the cost and inconvenience of the device. Another approach at this design requires a multi-piece garment containing a poncho like structure and a tent like structure and requires a separate support to hold up the tent like structure. This creates a bulky, complicated and inconvenient arrangement. The need remains for a personal shelter device having a lightweight structure design that is convertible between a single piece wearable poncho and a shelter device large enough to provide shelter for a plurality of human beings.

It is an objective of the present invention to provide a shelter device that is configurable between a wearable poncho and an enclosure capable of providing shelter to a plurality of human beings for either camping or sleeping.

Other objects and advantages will appear hereinbelow.

SUMMARY OF THE INVENTION

In accordance with the present invention, the foregoing objects and advantages are readily attained.

According to the present invention, a personal shelter device is provided which includes a foldable outer structure convertible between a poncho configuration and a tent configuration, wherein when the structure is in the poncho configuration, the structure has a poncho front and a poncho rear so as to form a wearable garment and wherein when the structure is in the tent configuration the structure has a tent top, a tent base and a tent front, so as to form a shelter device which defines an enlargeable internal cavity for sheltering a plurality of human beings. Also provided is at least one supporting member for independently supporting the device when the structure is in the tent configuration, the supporting member or members being configurable between a compact position for storage when the structure is in the poncho configuration and an extended position for supporting the structure when the structure is in the tent configuration so as to form a self supporting structure.

BRIEF DESCRIPTION OF THE DRAWINGS

A detailed description of preferred embodiments of the present invention follows, with reference to the attached drawings, wherein.

DETAILED DESCRIPTION

Figure 1A:
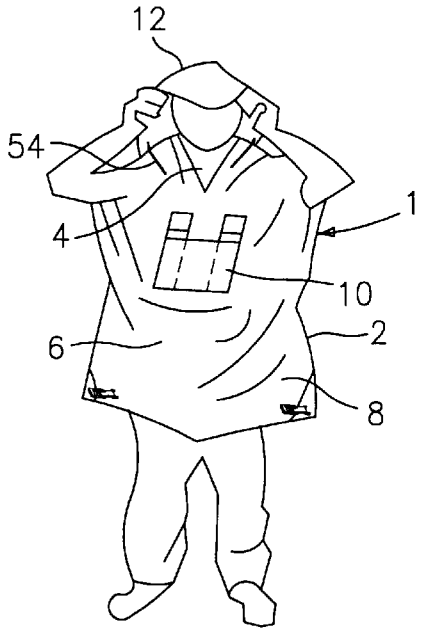
FIG. 1*a* illustrates a person wearing a personal shelter device with the personal shelter device in the poncho configuration and the hood feature being used, in accordance with the present invention.
Figure 1B:
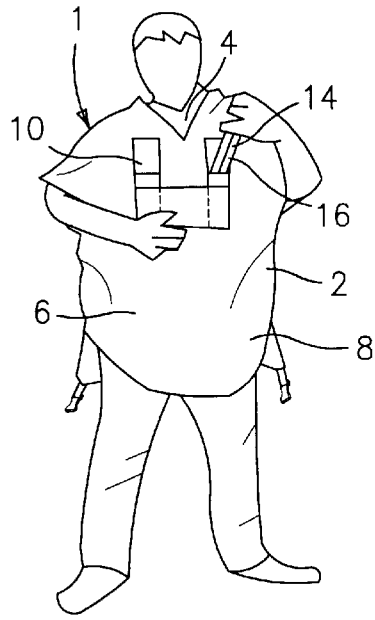
FIG. 1*b* illustrates a person wearing a personal shelter device with the personal shelter device in the poncho configuration without the hood feature being used and removing the supporting members or members from the front enclosure while the supporting members or members are in the compact position, in accordance with the present invention.
Figure 1C:
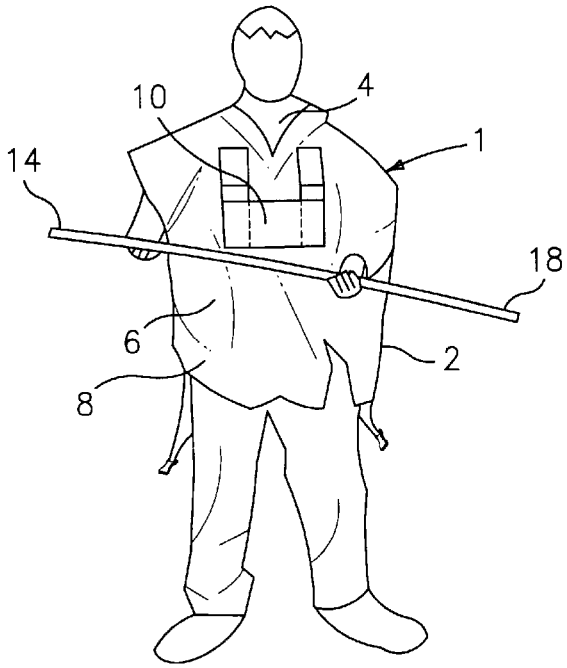
FIG. 1*c* illustrates a person wearing a personal shelter device with the personal shelter device in the poncho configuration and a supporting member in the extended position , in accordance with the present invention.

In accordance with the present invention, a personal shelter device capable of being converted between a poncho configuration and a tent configuration is provided. The personal shelter device includes a foldable outer structure that is convertible between a poncho configuration and a tent configuration. When the outer structure is in the poncho configuration, the structure has a poncho front and a poncho rear so as to form a wearable garment. When the outer structure is in the tent configuration the structure has a tent top, a tent base and a tent front, so as to form a shelter device that defines an enlargeable internal cavity for sheltering a plurality of human beings. In addition, the personal shelter device includes at least one supporting member for independently supporting the outer structure when the structure is in the tent configuration. The supporting member or members are configurable between a compact position for storage when the structure is in the poncho configuration and an extended position for supporting the structure when the structure is in the tent configuration so as to form a self supporting structure Referring to the drawings, in accordance with the present invention FIG. 1*a*, FIG. 1*b* and FIG. 1*c* illustrate a personal shelter device 1 in the poncho configuration 2 and shows a structure 8 having an opening 4 for receiving the head of a human being, a poncho front 6, a pocket 10 and an adjustable hood 12 having at least one adjusting member 54. In addition, a separate flexible supporting member 14 is shown in the compact position 16 and in the extended position 18. In accordance with the present invention, one or more flexible supporting members 14 may be provided and are preferably flexible and collapsible and may be made from any suitable material in the art, including wood, plastic, nylon, Kevlar or the like.

Figure 2A:
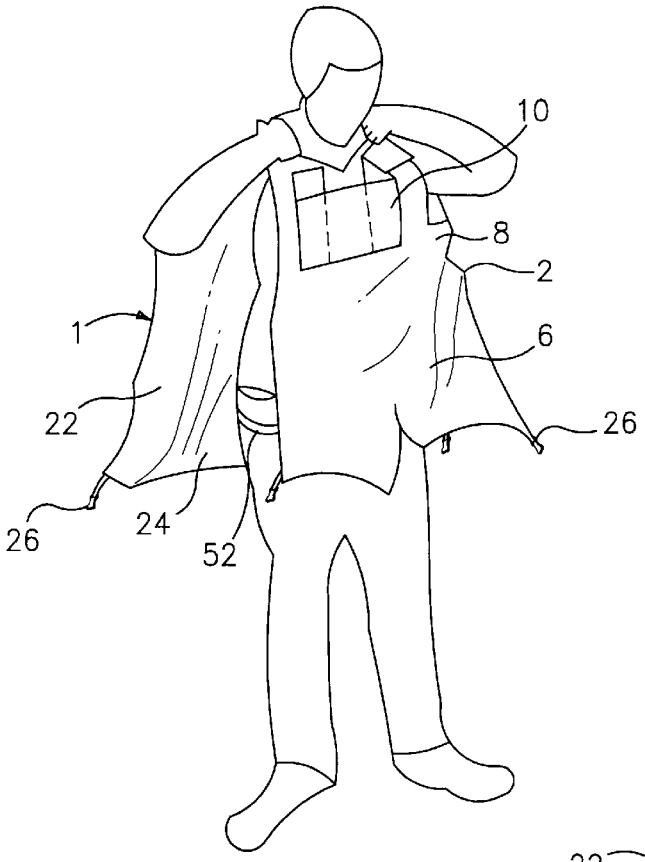
FIG. 2*a* and FIG. 2*b* illustrate a person removing a personal shelter device with the personal shelter device in the poncho configuration, in accordance with the present invention.
Figure 2B:
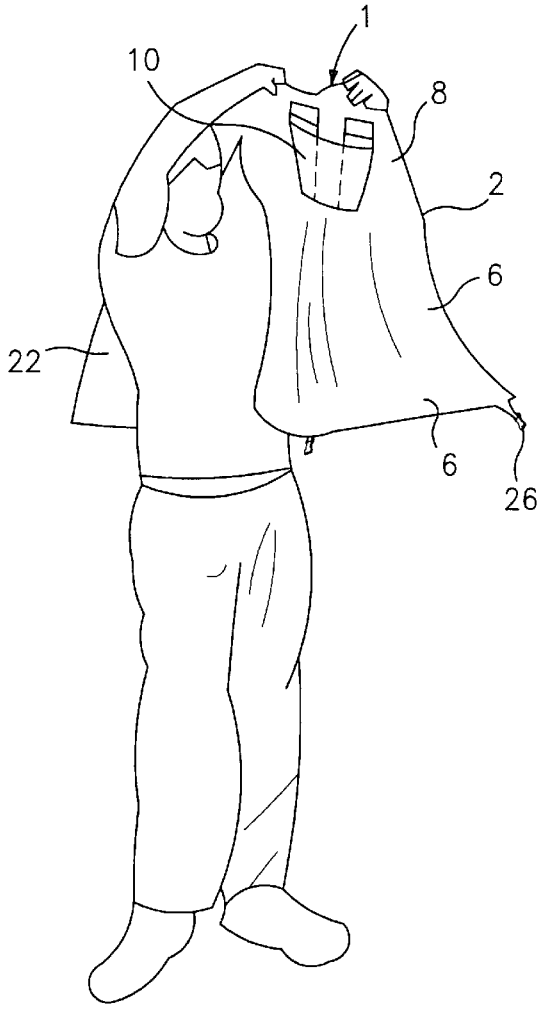
Figure 3:
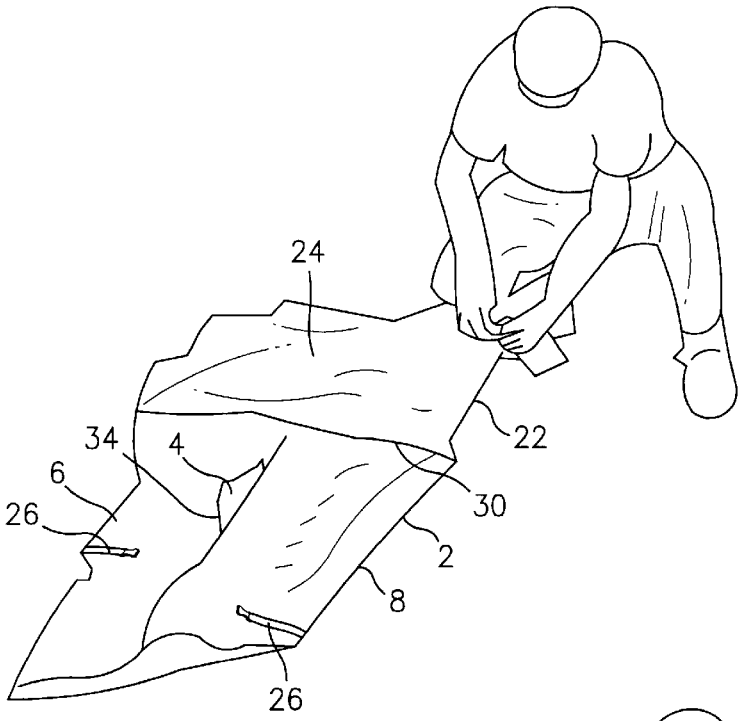
FIG. 3 illustrates a person converting a personal shelter device from the poncho configuration into the tent configuration.
Figure 4:
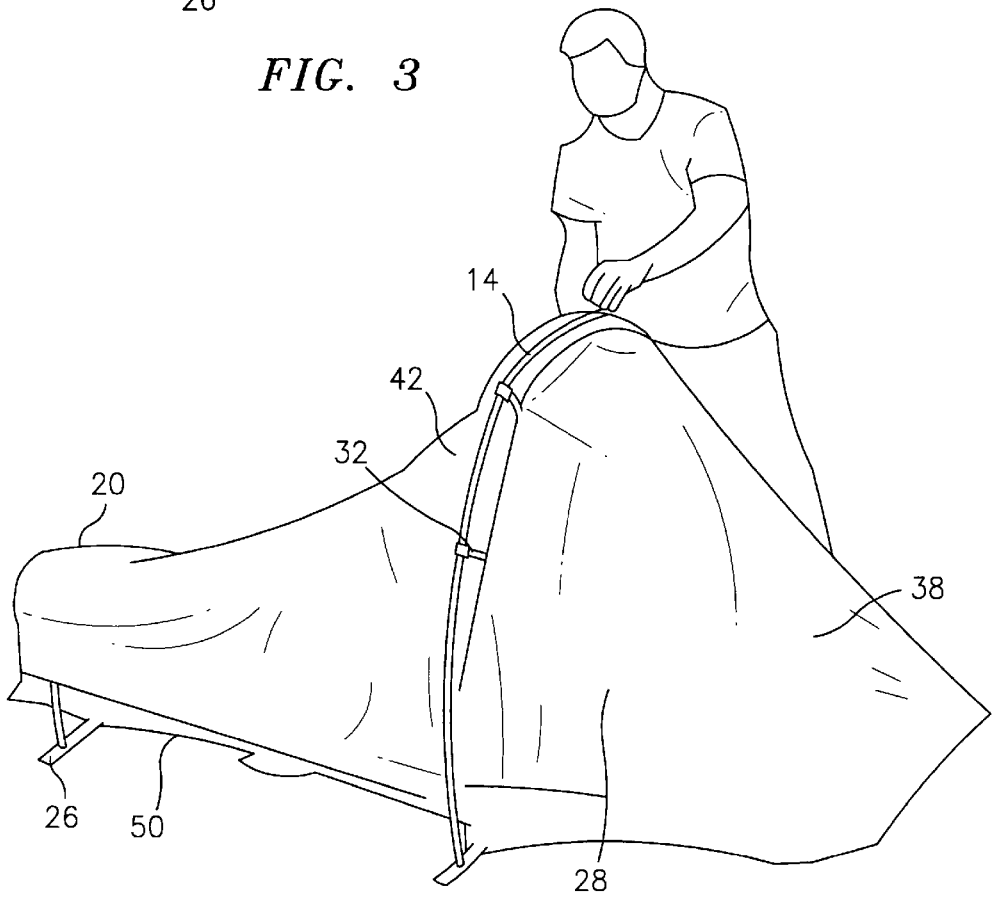
FIG. 4 illustrates a person converting a personal shelter device from the poncho configuration into the tent configuration.
Figure 5:
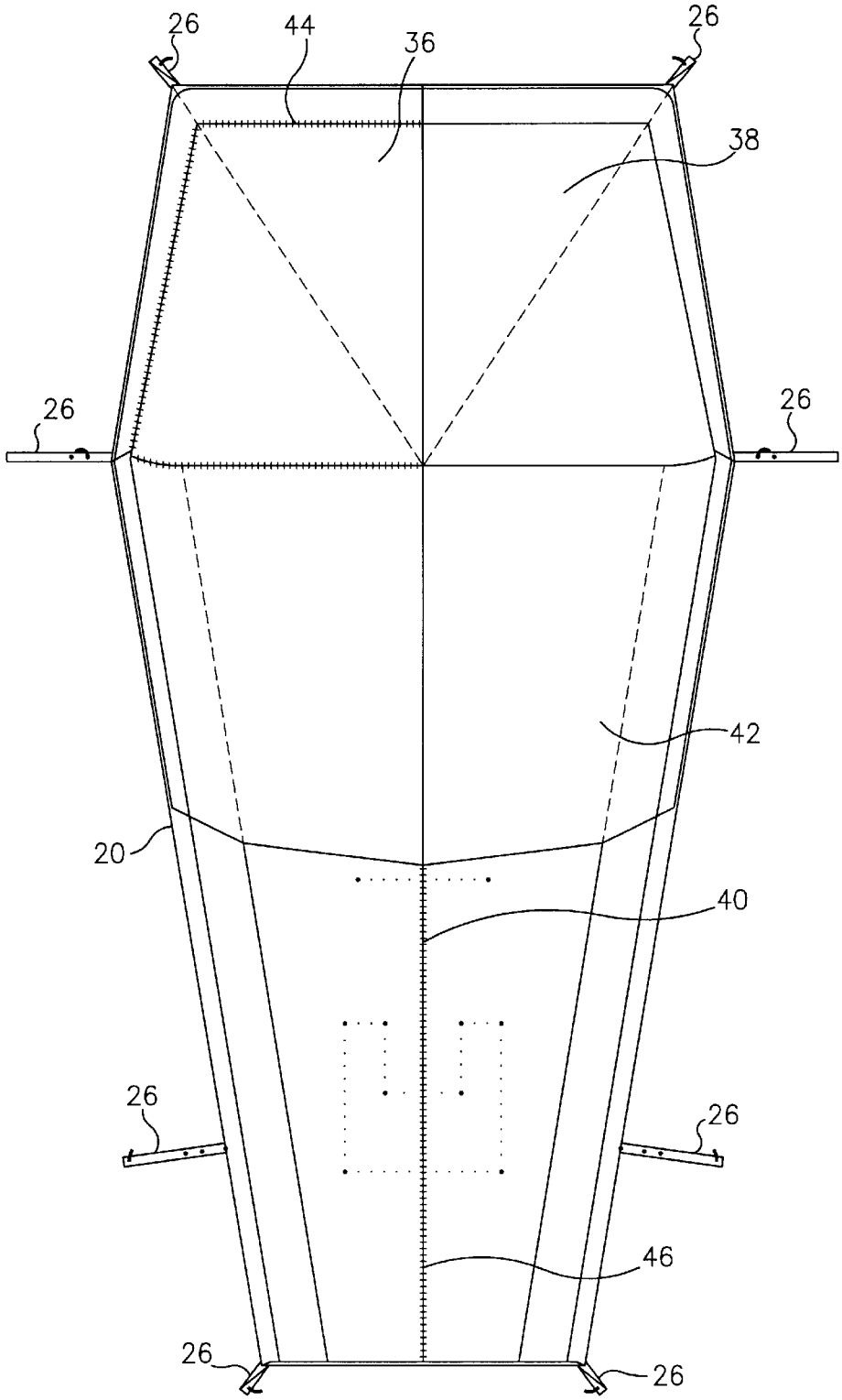
FIG. 5 illustrates a top down view of a personal shelter device in the tent configuration.

Referring to FIG. 2*a*, FIG. 2*b*, FIG. 3, FIG. 4, FIG. 5 and FIG. 6 a personal shelter device 1 is illustrated, in accordance with the present invention, being removed from a person and being configured from a poncho configuration 2 into a tent configuration 20. The drawings show a poncho front 6, a poncho rear 22 and an extended portion 24 when the structure 8 is in the poncho configuration 2 as shown in FIG. 2*a*, and a tent front 38, a tent top 42 and a tent base 50 when the structure 8 is in the tent configuration 20 as shown in FIG. 4. Personal shelter device 1 preferably defines an enlargeable internal cavity 28 for containing one or more human beings when the personal shelter device 1 is in the tent configuration 20, for example one, two or three persons can easily be accommodated. The enlargeable internal cavity 28 is collapsed when the personal shelter device 1 is in the poncho configuration 2 and is enlarged when the personal shelter device 1 is in the tent configuration 20.

A preferred embodiment will now be discussed. When the personal shelter device 1 is in the poncho configuration 2, internal cavity 28 is collapsed so as to minimize the volume. The extended portion 24 is folded and secured to the poncho rear 22 via at least one securing member 30. In accordance with the present invention, securing members 30 may be any suitable securing device known in the art, such as a water resistant zipper or the like. Opening 4 is placed over the head of a person wearing the device so as to allow the structure 8 to rest on the shoulders of the person wearing the personal shelter device 1. The personal shelter device 1 is disposed on the person so that the poncho front 6 is covering the front torso area of the person and the poncho rear 22 is covering the rear torso area of the person. The poncho front 6 may then be secured to the poncho rear 22 via at least one or more attaching member 52. When the structure 8 is in the poncho configuration 2 the supporting member or members 14 are configured into the compact position 16 and may be contained within the pocket 10. The adjustable hood 12 may or may not be worn by the person. In addition, the adjustable hood 12 includes at least one adjusting member 54, as a drawstring, which is used to adjust the size of the hood 12.

Figure 6:
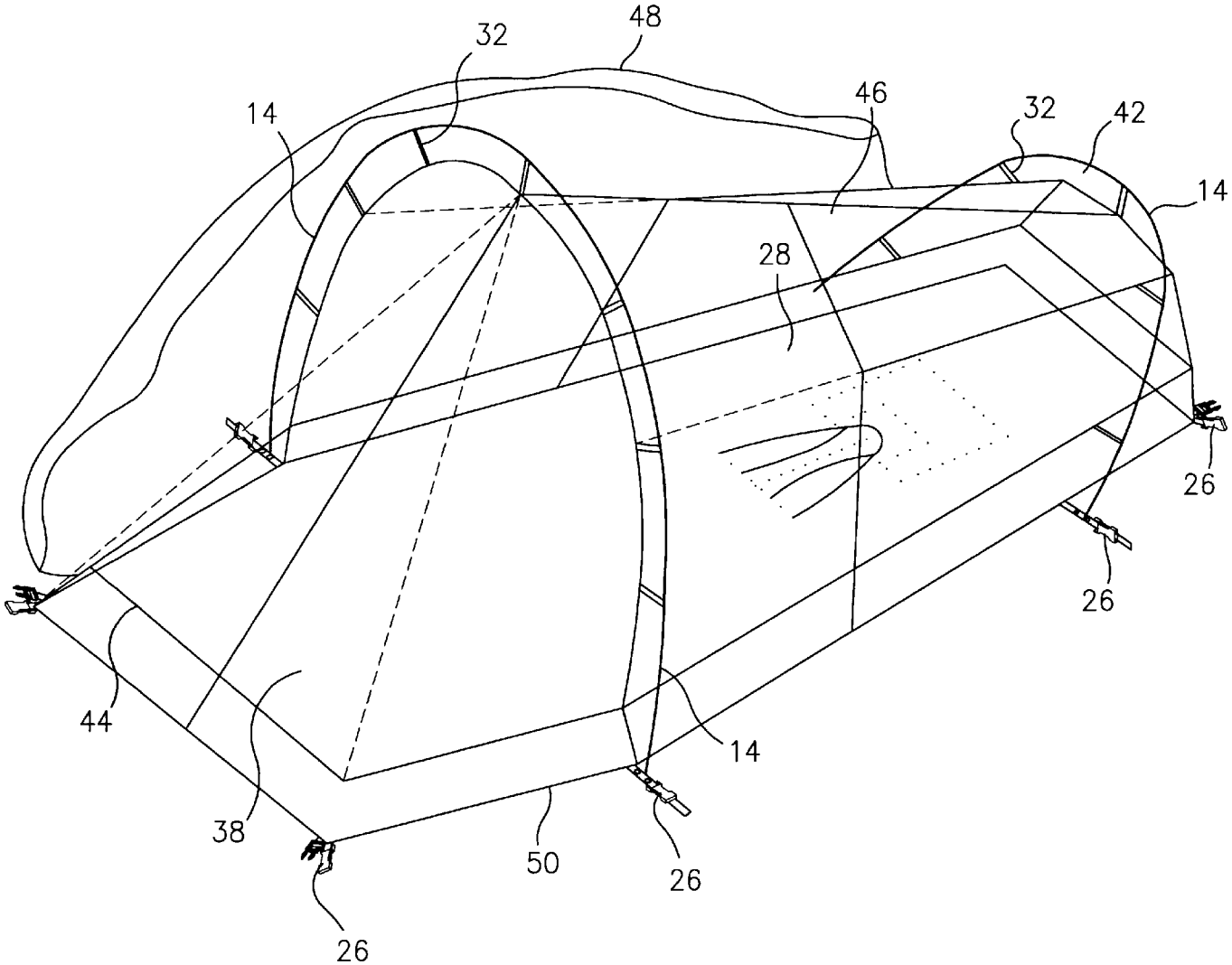
FIG. 6 illustrates a side view of a personal shelter device in the tent configuration.

When the person is ready to configure the personal shelter device 1 into the tent configuration 20, the supporting member or members 14 are removed from the pocket 10, the poncho front 6 is unsecured from the poncho rear 22 and the personal shelter device 1 is removed from the person. The opening 4 is then sealed via a sealing member 34 and the personal shelter device 1 is placed on a flat surface so as to cause the personal shelter device 1 to be spread out lengthwise. In accordance with the present invention, sealing member 34 may be any suitable sealing device known in the art, such as a water resistant zipper or the like. The personal shelter device 1 is placed so that the extended portion 24 is facing upward. The extended portion 24 is then unsecured from the poncho rear 22 and unfolded, so that personal shelter device 1 is fully extended. At least one supporting member 14 is then fastened to the personal shelter device 1, via a plurality of fastening members 32, so as to enlarge the volume of the internal cavity 28 when the structure 8 is in the tent configuration 20. As shown in FIG. 6, fastening member 32 may be disposed in a plurality of locations on personal shelter device 1 so as to allow for the use of multiple supporting members 14. In accordance with the present invention, fastening members 32 may be any suitable fastening device known in the art, such as straps, grommets, snaps, hooks or the like. The tent base 50 of the personal shelter device 1 is then anchored to the ground via a plurality of anchoring members 26 so as to stabilize the personal shelter device 1. In accordance with the present invention, anchoring members 26 may include any suitable anchoring device known in the art, such as grommets, straps, cords, ropes, snaps, hooks or the like. The personal shelter device 1 is now ready to be used as a shelter. When in the tent configuration 20, entrance to the personal shelter device 1 can be gained either through an entrance opening 36 disposed on the tent front 38 or an auxiliary opening 40 disposed on the tent top 42. The entrance opening 36 is disposed on the tent front 38 and secured via an entrance securing member 44 which can be operated from inside and outside the personal shelter device 1. In accordance with the present invention, entrance securing member 44 may be any suitable securing device known in the art, such as zippers, snaps, buttons, Velcro or the like. The auxiliary opening 40 is disposed on the tent top 42 and closed via a closing member 46 that also can be operated from inside and outside the personal shelter device 1. In accordance with the present invention, closing member 46 may be any suitable closing device known in the art, such as zippers, snaps, buttons or the like. To enter the personal shelter device 1, the entrance securing member 44 is unsecured so as to allow communication with the internal cavity 28. The material surrounding the entrance opening 36 is preferably a mesh material so as to allow visual communication with the internal cavity 28 but may be constructed of any material suitable to the desired end purpose. Once a person has entered the internal cavity 28, the entrance securing member 44 can be secured so as to close off communication with the internal cavity 28.

In addition, as shown in FIG. 6, when the personal shelter device 1 is in the tent configuration 20, a water resistant membrane 48 may be secured to the outside of the personal shelter device 1 using the anchoring members 26, so as to increase the water resistance of the personal shelter device 1. In accordance with the present invention, when the structure 8 is in the poncho configuration 2 the size of the internal cavity 28 is minimized and when the structure 8 is in the tent configuration 20 the size of the internal cavity 28 is maximized.

Also, when the personal shelter device 1 is not in use, it may be folded up and stored in the hood 4. The hood 4 may then be fastened to a person's belt using the adjusting member 54. In accordance with the present invention, the adjusting member 54 may be any suitable device known in the art including drawstrings, straps, Velcro or the like.

In accordance with the present invention, the personal shelter device can be constructed of any suitable material, or a combination of suitable materials, known in art. Preferably, the material should be lightweight, water-resistant, flexible and breathable.

In accordance with the present invention, the water resistant membrane may be constructed of any suitable water resistant material known in the art, such as plastic or the like.

In accordance with the present invention, the supporting member 14 may be made from any suitable material known in the art, such as plastic, wood, Kevlar or the like.

In accordance with the present invention, the fastening members may be any suitable fastening members known in the art, such as Velcro, snaps, buckles, buttons, grommets or the like.

In accordance with the present invention, the anchoring members may be made from any suitable material known in the art, such as nylon, rope, plastic or the like.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A personal shelter device comprising:

a foldable outer structure convertible between a poncho configuration and a tent configuration, wherein when said structure is in said poncho configuration, said structure has a poncho front and a poncho rear so as to form a wearable garment and wherein when said structure is in said tent configuration said structure has a tent top, a tent base and a tent front, so as to form a shelter device which defines an enlargeable internal cavity for sheltering a plurality of human beings; and wherein in the poncho configuration said poncho having a length and a width on the front and rear portions thereof, and wherein said poncho rear includes an extendable portion, said extendable portion being folded over against the poncho rear portion and hidden when said structure is in said poncho configuration to substantially extend over the entire width of the poncho rear portion, and extended when said structure is in said tent configuration, with said structure including a securing means for securing said extendable portion to said poncho rear when said structure is in the poncho configuration; and at least one supporting means for independently supporting said device when said structure is in said tent configuration, said supporting means being configurable between a compact position for storage when said structure is in said poncho configuration and an extended position for supporting said structure when said structure is in said tent configuration so as to form a supported structure, with said structure further including a pocket for storing said supporting means when said supporting means is in said compact position.

2. A personal shelter device according to claim 1, wherein when said structure is in said poncho configuration, said structure includes an opening for receiving the head of a human being.

3. A personal shelter device according to claim 2, wherein said structure further includes a sealing means for sealing said opening when said structure is in said tent configuration.

4. A personal shelter device according to claim 3, wherein said sealing means is a water-resistant zipper.

5. A personal shelter device according to claim 1, wherein when said structure is in said poncho configuration, said structure further includes a plurality of attaching means disposed so as to allow attachment of said poncho front to said poncho rear.

6. A personal shelter device according to claim 1, wherein said securing means is a water-resistant zipper.

7. A personal shelter device according to claim 1, wherein when said structure is in said poncho configuration, the size of said enlargeable internal cavity is minimized.

8. A personal shelter device according to claim 1, wherein when said structure is in said tent configuration, the size of said enlargeable internal cavity is maximized.

9. A personal shelter device according to claim 1, wherein when said structure is in said tent configuration, said structure further includes an entrance opening disposed on said tent front so as to allow communication with said enlargeable internal cavity.

10. A personal shelter device according to claim 9, wherein said entrance opening includes an entrance securing means for securing said entrance opening.

11. A personal shelter device according to claim 10, wherein said entrance securing means is a water-resistant zipper.

12. A personal shelter device according to claim 10, wherein said entrance securing means is operative from the inside or outside of said tent.

13. A personal shelter device according to claim 9, including mesh material surrounding said entrance opening.

14. A personal shelter device according to claim 1, wherein when said structure is in said tent configuration, said tent top includes an auxiliary opening having a means for closing said auxiliary opening.

15. A personal shelter device according to claim 14, wherein said means for closing said auxiliary opening is a water-resistant zipper.

16. A personal shelter device according to claim 1, wherein said structure further includes a plurality of fastening means for fastening said supporting means to said structure when said structure is in said tent configuration.

17. A personal shelter device according to claim 1, wherein said structure further includes a plurality of anchoring means so as to anchor said tent base when said structure is in said tent configuration.

18. A personal shelter device according to claim 1, wherein said structure is constructed of a lightweight, water-resistant, flexible and breathable material.

19. A personal shelter device according to claim 1, wherein said structure further includes a hood for covering the head of a person when said structure is in said poncho configuration.

20. A personal shelter device according to claim 19, wherein said structure includes an adjusting means so as to allow said hood to be adjusted.

21. A personal shelter device according to claim 20, wherein said adjusting means is a drawstring.

22. A personal shelter device according to claim 1, wherein in the tent configuration including a water resistant material secured to the outside thereof.

23. A personal shelter device according to claim 1, having a coffin-like shape in the tent configuration.

24. A personal shelter device according to claim 1, having a four-sided shape in the poncho configuration.

* * * * *